US007721627B2

(12) United States Patent
Basham et al.

(10) Patent No.: US 7,721,627 B2
(45) Date of Patent: May 25, 2010

(54) ATTACHMENTS FOR POWER TOOLS

(75) Inventors: Russell Dale Basham, Georgetown, KY (US); James Jerald Howard, Owingsville, KY (US)

(73) Assignee: Toyota Motor Engineering & Manufacturing North America, Inc., Erlanger, KY (US)

( * ) Notice: Subject to any disclaimer, the term of this patent is extended or adjusted under 35 U.S.C. 154(b) by 132 days.

(21) Appl. No.: 11/866,015

(22) Filed: Oct. 2, 2007

(65) Prior Publication Data

US 2009/0084567 A1 Apr. 2, 2009

(51) Int. Cl.
*B25B 17/00* (2006.01)

(52) U.S. Cl. ..... 81/57.14; 81/57.3

(58) Field of Classification Search ..... 81/57.14, 81/57.3, 57.26, 57.29
See application file for complete search history.

(56) References Cited

U.S. PATENT DOCUMENTS 1,042,736 A * 10/1912 Wildmo ..... 81/57.3
1,346,505 A * 7/1920 Mitchell ..... 81/57.3
1,378,719 A * 5/1921 Poole ..... 81/57.3
1,423,142 A * 7/1922 Owens ..... 81/57.3
1,614,534 A * 1/1927 Norton ..... 81/57.3
3,602,071 A * 8/1971 Juhasz ..... 81/57.14
3,620,105 A * 11/1971 Batten ..... 81/57.14
3,630,108 A 12/1971 Stillwagon, Jr.
4,171,651 A * 10/1979 Dacunto ..... 81/57.29
4,179,955 A * 12/1979 Akiyoshi et al. ..... 81/57.11
4,240,310 A * 12/1980 Roth ..... 81/57.29
4,244,246 A 1/1981 Gillett
4,287,795 A * 9/1981 Curtiss ..... 81/57.26
4,374,479 A * 2/1983 Minotti ..... 81/57.3
4,462,468 A 7/1984 Jenne
4,735,118 A * 4/1988 Broemel, Jr. ..... 81/57.3
4,827,810 A * 5/1989 Rushanan ..... 81/57.29
4,836,062 A 6/1989 LaTorre
4,836,067 A 6/1989 Rogers et al.
5,522,285 A * 6/1996 Wilson et al. ..... 81/57.14
5,522,286 A * 6/1996 Wilson et al. ..... 81/57.26
5,616,095 A * 4/1997 Pruitt ..... 475/178
5,697,266 A * 12/1997 Wilson, Jr. ..... 81/57.14
H1821 H 12/1999 Kosinski
6,330,840 B1 * 12/2001 McCormick et al. ..... 81/57.3
6,401,572 B1 * 6/2002 Provost ..... 81/57.14
6,481,084 B2 11/2002 Pool et al.
6,796,385 B1 * 9/2004 Cobzaru et al. ..... 173/1
6,923,094 B1 * 8/2005 Marquardt ..... 81/57.3
6,959,625 B2 11/2005 Pettit, Jr.
7,225,707 B2 * 6/2007 Knopp ..... 81/57
2002/0096020 A1 * 7/2002 Hart et al. ..... 81/57.14
2003/0041704 A1 3/2003 Pelt
2004/0093992 A1 * 5/2004 Wojtynek ..... 81/57.3
2007/0022846 A1 * 2/2007 Fryatt ..... 81/57.3

* cited by examiner

*Primary Examiner*—David B Thomas
(74) *Attorney, Agent, or Firm*—Dinsmore & Shohl LLP

(57) ABSTRACT

An attachment for a power tool to facilitate the insertion and removal of fasteners in otherwise inaccessible locations including an adapter having a bolting insert, the bolting insert including a drive gear configured to engage a rotating drive mechanism of the power tool such that rotation of the drive mechanism rotates the drive gear, which in turn rotates a bolting gear engaged with a fastener.

20 Claims, 6 Drawing Sheets

ATTACHMENTS FOR POWER TOOLS

TECHNICAL FIELD

The present invention relates to tool attachments and, more specifically, to off-set drive bolting attachments for power tools.

BACKGROUND

The position and placement of a fastener, such as a bolt, screw, or nut, does not always permit the use of conventional tools to facilitate the installation and removal of the fastener. This is particularly true when there is only minimal clearance in the area surrounding the fastener such that it is impossible to engage the fastener with a conventional tool (e.g., as in the attachment of vehicle doors to the vehicle body during assembly). Particularly, the relative position and proximity of a vehicle body to a vehicle door (e.g., the hinge portion of the door) does not permit the use of a conventional impact gun where the drive mechanism is located directly behind the socket that engages the fastener.

To overcome this problem, tool attachments have been produced that facilitate the use of conventional power tools to engage a fastener located in an otherwise inaccessible position. These attachments, also known as crow's foot attachments, can be affixed to the power tool and engaged with the drive mechanism of the power tool. FIG. 1 shows an example of a prior art crow's foot tool attachment. The attachment 2 comprises a shaft 4 having a socket 6 fixed thereon. The socket 6 is connected to the shaft 4 with a swivel joint (not shown), such as a ball and socket joint, that permits the socket 6 to be adjustably positioned on the end of the shaft 4. The opposite end 10 of the shaft is configured to attach to the drive mechanism 12 of a power tool 14 having an axis of rotation 18 and a plane of rotation 20. When engaged with a fastener 16, the socket rotates about a second, different axis of rotation 38 and in a second, different rotation plane 30.

While generally suitable for the purpose of engaging otherwise inaccessible fasteners, the existing tool attachments have several drawbacks including tool slippage and stripping of the fastener 16. This is because the force F applied to the power tool 14 to keep the socket 6 engaged with the fastener 16 has both a perpendicular component 44 and a parallel component 45 relative to the socket 6. The perpendicular component 44 of the force F causes the operator to have poor control over both the fastener 16 and the power tool 14 at the interface of the fastener 16 with the socket 6 resulting in slippage of the socket 6 on the fastener 16. Slippage of the socket 6 on the fastener 16 may cause the fastener 16 to become stripped necessitating removal and replacement of the fastener 16. If the socket 6 becomes fully disengaged from the head of the fastener 16 during installation or removal of the fastener 16, damage may occur to the workpiece 50 as the rotating attachment 2 comes in contact with portions of the workpiece 50.

Other embodiments of prior tool attachments include those that are configured to be affixed to specialized power tools and engaged with the drive mechanism of the power tool such that the rotational motion of the drive mechanism is translated to a different rotational axis and plane. Such attachments use gears, shafts, and spline gears to translate the rotational motion of the power tool. However, these tools suffer from the same slippage problems as the apparatus shown in FIG. 1. Further, such attachments are expensive (as are the specialized power tools required for operation), the translation mechanism is often intricate, heavy, and susceptible to breakage, and repair of the mechanism can be difficult and time consuming.

Accordingly, a need exists for an inexpensive, ergonomically correct, versatile, and easily operated tool attachment for facilitating the insertion and removal of fasteners in otherwise inaccessible locations.

SUMMARY

The present invention may include an attachment for a power tool to facilitate the insertion of fasteners in otherwise inaccessible locations. The attachment may have an adapter with a first end and a second end. The second end of the adapter may be operable for fastening the attachment to a power tool. The first end of the adapter may have a bolting insert secured thereto. The bolting insert may comprise a drive gear configured to engage the drive mechanism of the power tool and a bolting gear. The drive gear and the bolting gear may be arranged such that rotation of the driving gear causes the rotation of the bolting gear.

In another embodiment, the present invention may include an attachment for a power tool. The attachment may have an adapter with a first end and a second end. The second end of the adapter may be operable for fastening the attachment to the power tool. The first end of the adapter may have a bolting insert secured thereto. The bolting insert may contain a drive gear configured to engage the rotating drive mechanism of the power tool. The bolting insert may also contain a bolting gear and a center gear disposed between the bolting gear and the drive gear. The drive gear, bolting gear and center gear may be arranged such that rotation of the drive gear causes the rotation of the center gear and the bolting gear.

In another embodiment, the present invention may include an attachment for translating the rotation of a power tool from a first axis of rotation to a second, parallel axis of rotation in the same or a parallel plane. The attachment may comprise an adapter for affixing the attachment to the power tool. The attachment may also comprise a bolting insert associated with the adapter. The bolting insert may include a drive gear for interfacing with a power tool and a bolting gear for interfacing with a fastener. The drive gear may comprise a first axis of rotation and the bolting gear may comprise a second axis of rotation parallel to the first axis of rotation. The drive gear and bolting gear may be operatively engaged with one another in a common rotational plane such that rotation of the drive gear causes the rotation of the bolting gear.

BRIEF DESCRIPTION OF THE DRAWINGS

The following detailed description of specific illustrative embodiments of the present invention can be best understood when read in conjunction with the following drawings in which.

DETAILED DESCRIPTION OF THE ILLUSTRATIVE EMBODIMENTS

Figure 2:
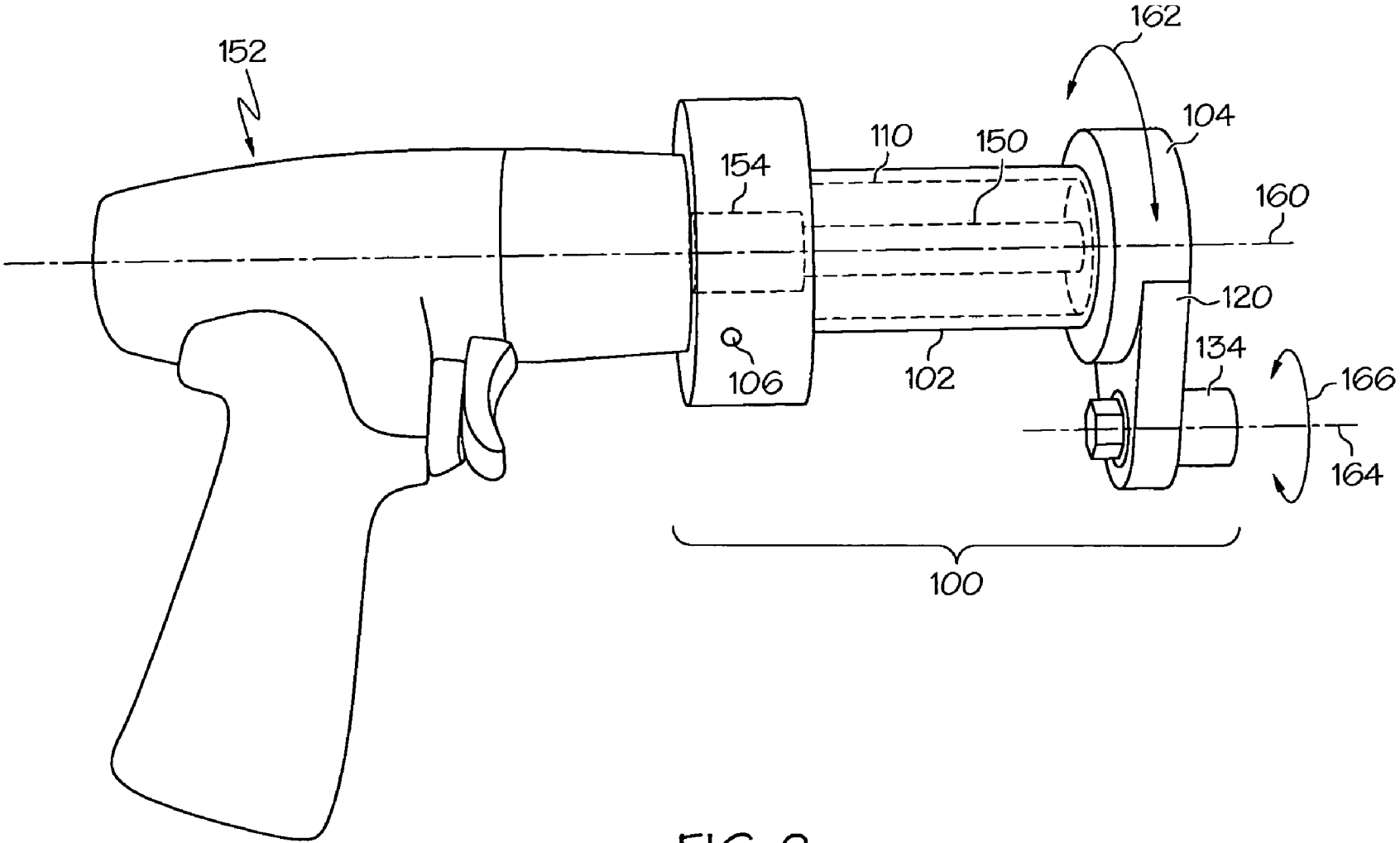
FIG. 2 is a schematic diagram showing an attachment in accordance with one exemplary embodiment of the present invention affixed to a power tool.

FIG. 2 shows an attachment 100 in accordance with one exemplary embodiment of the present invention. The attachment 100, illustrated as being affixed to a power tool 152 having a drive mechanism 154, may generally comprise an adapter portion 102 with a bolting insert portion 120. Each of these portions will be described more fully herein. As discussed herein, tool attachments of the present invention facilitate the insertion and removal of fasteners in difficult or generally inaccessible positions, such as those used to secure a vehicle door to a vehicle body.

Figure 3A:
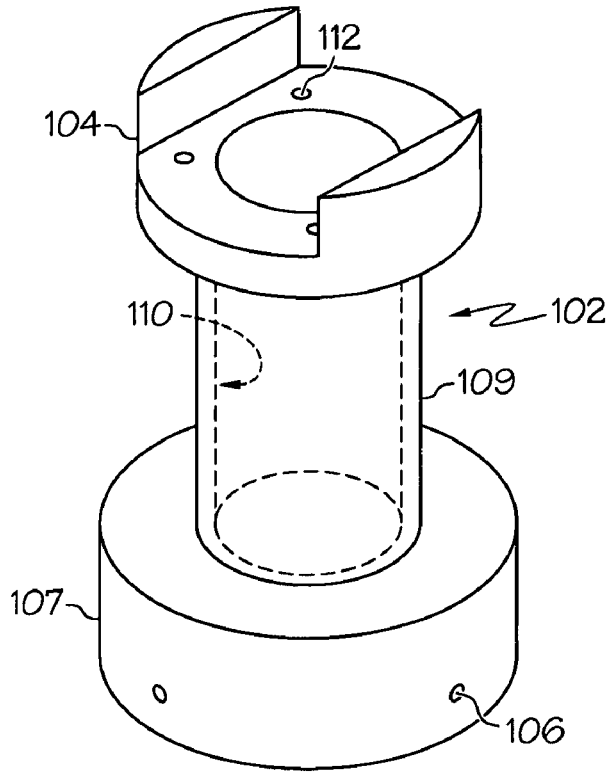
FIG. 3A is a top perspective view of the adapter portion of an attachment in accordance with one exemplary embodiment of the present invention.
Figure 3B:
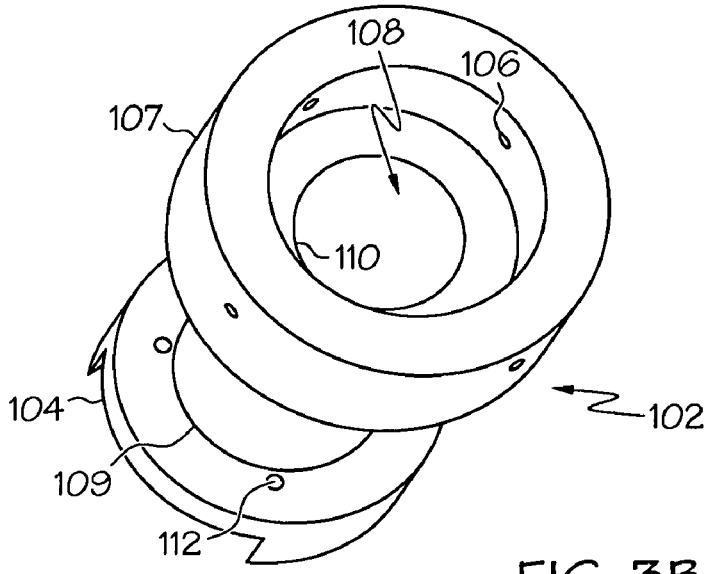
FIG. 3B is a bottom perspective view of the adapter portion of FIG. 3A in accordance with one exemplary embodiment of the present invention.

Referring now to FIGS. 2 and 3A-3B, the adapter portion 102 of the attachment 100 in accordance with one exemplary embodiment of the present invention is shown. The adapter portion 102 may be configured with a receptacle 104 for receiving a bolting insert portion 120 (shown in FIGS. 2, 4, and 5) and a base 107 for securing the adapter to a power tool with a column 109 therebetween. As shown in FIG. 3B, the adapter portion 102 may contain an opening 108 within the base 107 for receiving a power tool 152. A hollow channel 110 may extend along the length of the adapter portion 102 (e.g., through base 107 and column 109) connecting the opening 108 with the receptacle 104. Set screws 106 may be located within the base 107 and adjacent the opening 108 to set the adapter portion 102 in place on the power tool 152. In another embodiment the base 107 may comprise threads on the inner diameter of the base 107 to secure the adapter 102 to a power tool (e.g., through corresponding threads on the power tool). The adapter portion 102 may also be configured with threaded holes 112 located in the receptacle 104 and configured to attach the bolting insert portion 120 to the adapter portion 102. The adapter portion 102 may be constructed from a lightweight material such as aluminum or titanium alloys.

It should be understood that adapters 102 illustrated in FIGS. 3A and 3B and described herein are exemplary in nature and that any arrangement of an adapter so configured to secure a bolting insert thereto, and/or to provide attachment between a bolting insert and a power tool can be utilized.

Figure 4A:
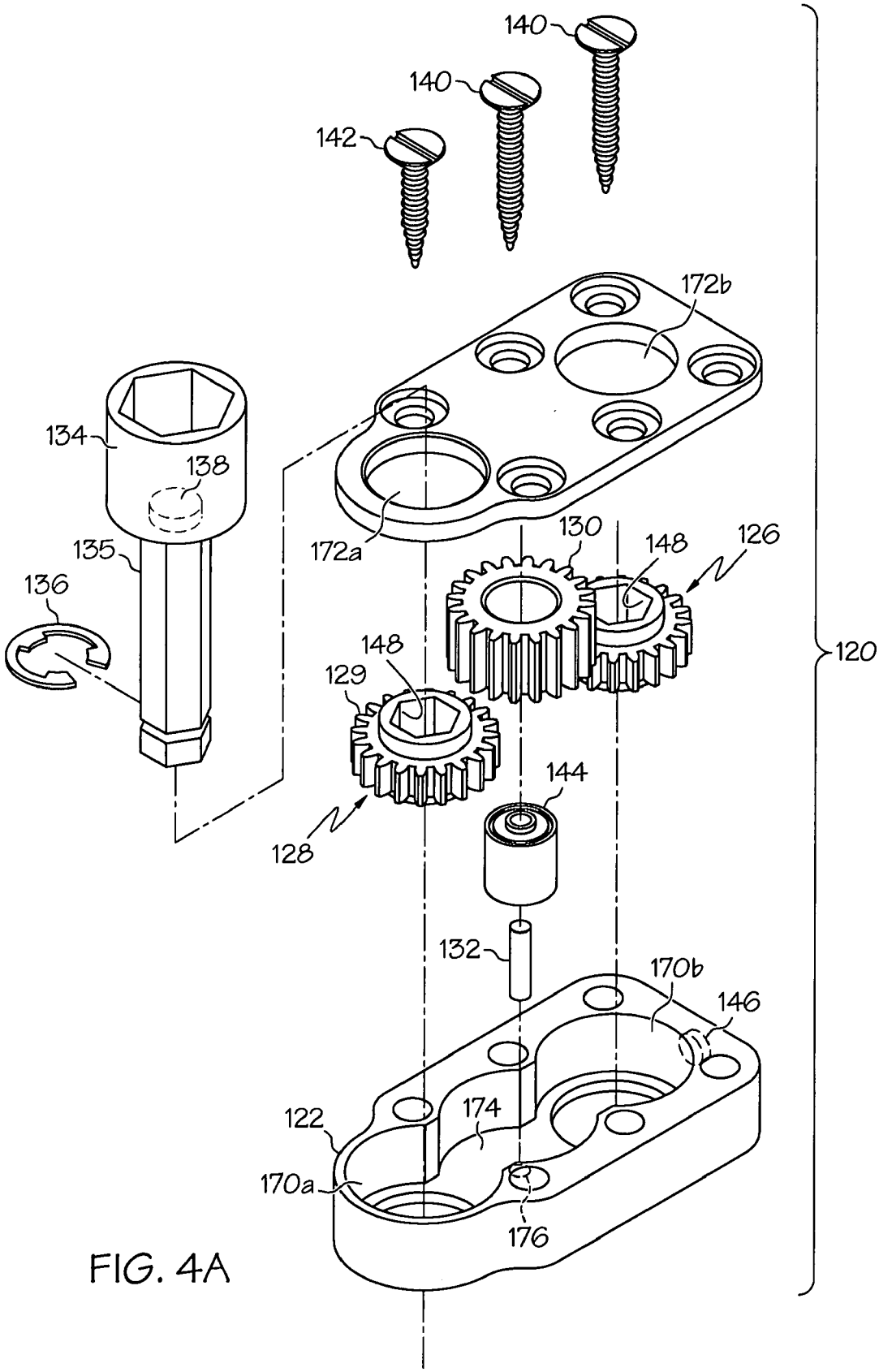
FIG. 4A is an exploded view of a bolting insert portion of an attachment in accordance with one exemplary embodiment of the present invention.
Figure 4B:
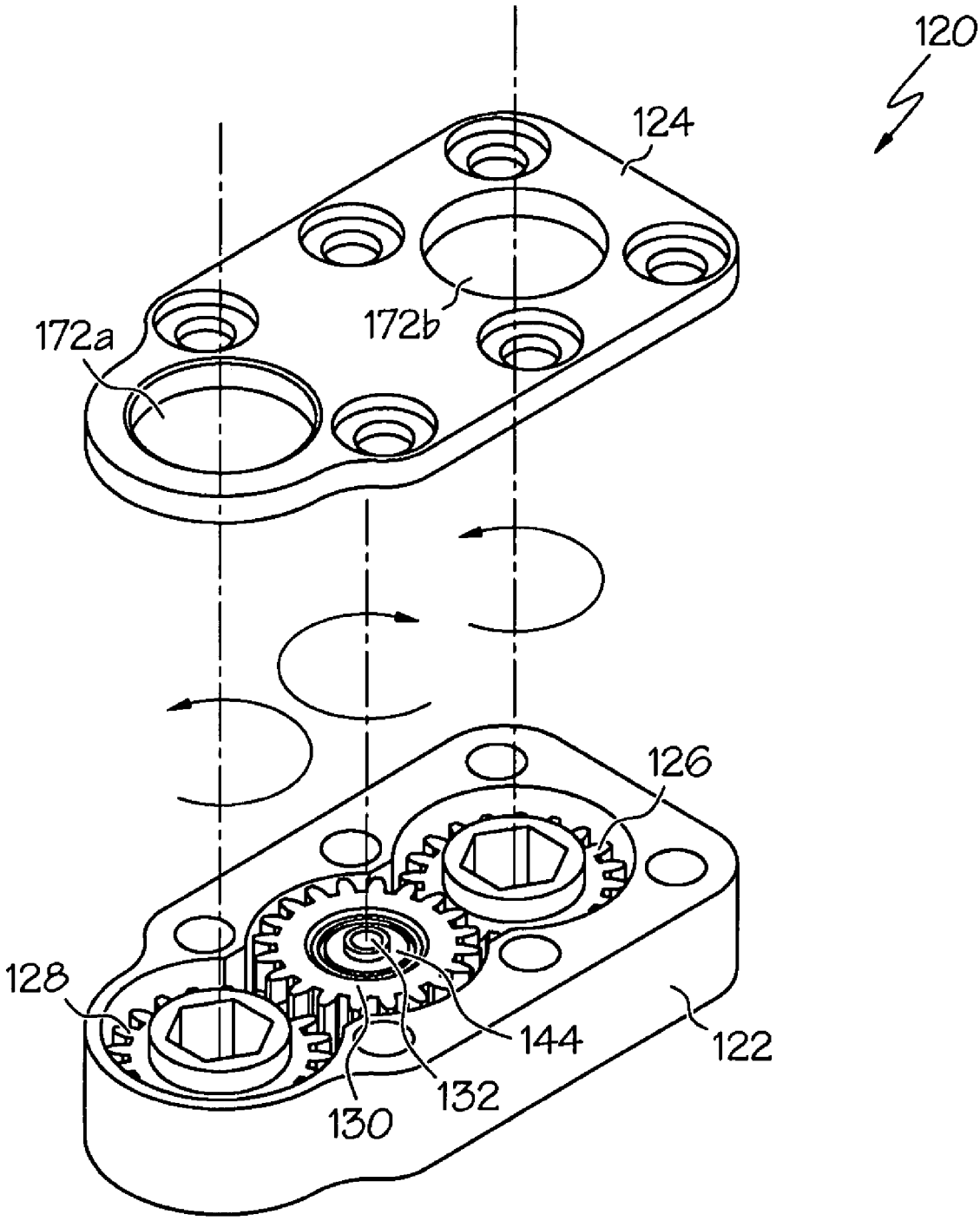
FIG. 4B is a perspective view showing the position and orientation of gears of the bolting insert portion of FIG. 4A in accordance with one exemplary embodiment of the present invention.

Referring to FIGS. 2 and 4A-4B, the bolting insert portion 120 of the attachment 100 in accordance with one exemplary embodiment of the present invention is shown. The bolting insert portion 120 may comprise a base 122 made of materials such as steel or titanium alloys. The base 122 may have at least two gears disposed therein, for example, a drive gear 126 and a bolting gear 128, operatively engaged with one another (e.g. through teeth 129) such that rotation of the drive gear 126 causes rotation of the adjacent bolting gear 128. As illustrated in FIG. 4B, the drive gear 126 and bolting gear 128 may be oriented in the same rotational plane. In one embodiment, as shown in FIGS. 4A and 4B, the drive gear 126 and the bolting gear 128 may be 12 mm hexagonal insert gears having a hexagonal mating surface 148 for receiving a hexagonal attachment extending through the center portion of the gear. Of course, any arrangement having any number of teeth or mating surfaces can be utilized. The drive gear 126 and bolting gear 128 may be positioned in the bolting insert portion 120 such that a portion of each gear 126,128 extends through openings 170*a*, 170*b* in the base 122 and through openings 172*a*, 172*b* in the cover 124 thereby securing each gear 126,128 between the base 122 and the cover 124 and providing an axis of rotation for each gear 126,128.

As illustrated in FIGS. 4A and 4B, the bolting insert portion 120 may further comprise at least one center gear 130 disposed between the drive gear 126 and the bolting gear 128 and operatively engaged with both the drive gear 126 and the bolting gear 128 such that rotation of the drive gear 126 may cause the rotation of the center gear 130 and the bolting gear 128. The center gear 130 may be fixed in position by a shaft 132 which may serve as the rotational axis of the center gear 130. The shaft 132 is secured in a recessed portion 176 in the base 122 and a corresponding recessed portion (not shown) in the cover 124 of the bolting insert portion 120. The center gear 130 may rotate about the shaft 132 on a bearing 144 removably inserted in the center gear 30.

In the 3-gear configuration of the bolting insert 120 shown in FIGS. 4A and 4B, the center gear 130 may serve several purposes. The bearing 144 on which the center gear 130 rotates also reduces friction in the bolting insert 120. As shown in FIGS. 4A and 4B, the center gear 130 may also increase the offset distance between the drive gear 126 and the bolting gear 128. As shown in FIG. 4B, the center gear 130, as an intermediary between the drive gear 126 and the bolting gear 128, may reverse the direction of rotation of the driving gear 126 thereby allowing the driving gear 126 and bolting gear 128 to rotate in the same direction. Finally, the center gear 130 being rotatably fixed to the shaft 132 which is, in turn, fixed to the based 122 and cover 124, may provide stability to the mechanism of the bolting insert portion 120.

Referring to FIGS. 4A, a socket insert 134 may be provided and removably inserted through the opening 172*a* in the cover 124, the bolting gear 128, and the opening 170 in the base 122. The socket insert 134 may have a hexagonal shaft 135 that engages with the hexagonal mating surface 148 of the bolting gear 128 as shown in FIG. 4A. The socket insert 134 may also comprise a magnet 138 for retaining fasteners. The socket insert 134 may be slidably secured by a retaining ring 136 placed around the hexagonal shaft 135. The socket insert 134 may also be interchangeable with other socket inserts configured to engage different types of fasteners. The cover 124 of the bolting insert portion 120 may be secured to the base 122 by screws 142 (one of which is shown) or any other securing arrangement.

Referring now to FIG. 4B, and as described more fully below, rotational motion of the drive gear 126 is imparted to the center gear 130 causing the center gear 130 to rotate in the opposite direction as the drive gear 126. The rotational motion of the center gear 130 is, in turn, imparted to the bolting gear 128 which rotates in the opposite direction of the center gear 130 (but in the same direction as the drive gear 126). As shown in FIG. 4A, when the hexagonal shaft 135 of the socket insert 134 is engaged with the hexagonal mating surface 148 of the bolting gear 128 the rotation of the bolting gear 128 also rotates the socket insert 134.

It should be understood that the bolting inserts described herein can have any number of gears in any number of sizes and arrangements configured to manipulate the distance between a drive gear (e.g., the gear that engages the power tool) and the bolting gear (e.g., the gear that engages the fastener or socket insert) so as to effectively transfer the drive from a power tool to a desired location, such as when inserting or removing fasteners in generally inaccessible positions. For example, gears can be positioned in a horizontal, vertical, diagonal or staggered arrangement depending on the position of the fastener. Accordingly, the attachment including the bolting insert described herein should not be limited to that illustrated in the drawings or otherwise described herein.

Referring now to the adapter portion 102 and bolting insert portion 120 of the attachment 100 in accordance with the exemplary embodiment of the present invention shown in FIGS. 2, 3A-3B and 4A-4B, once assembled, the bolting insert portion 120 may be removably inserted in the receptacle 104 of the adapter portion 102 such that the drive gear 126 is positioned over the channel 110 in the adapter portion 102. The bolting insert portion 120 may then be secured to the adapter portion 102 with screws 140 (two of which are shown) that may extend through the cover 124 and the base 122 and into the threaded holes 112 of the adapter portion 102. In another embodiment, the bolting insert portion 120 may be removably secured to adapter portion 102 through a snap and lock arrangement or any other arrangement suitable for removably securing the bolting insert portion 120. Of course, it should be understood that bolting insert portion 120 and adapter portion 102 may be integral, although such a configuration may not be desirable in an embodiment wherein changing of worn gears is needed.

Once the adapter portion 102 and the bolting insert portion 120 are secured, and referring specifically to FIG. 2, a power tool 152 having a drive socket 150 attached to the drive mechanism 154 may be inserted in the opening 108 of the adapter 102 such that the drive socket 150 extends through the channel 110 of the adapter 102 and in contact with the drive gear 126. The drive socket 150 may be a hexagonal drive socket that engages with the hexagonal mating surface 148 of the drive gear 126, as shown in FIGS. 4A and 4B. The adapter portion 102 may be rotated on the power tool 152 until suitable positioning of the attachment 100 is achieved for the specific application. The adapter portion 102 may then be secured to the power tool 152 with set screws 106. In another embodiment, as described above, the adapter portion 102 may comprise threads in the base 107 to secure the adapter portion 102 to mating threads on the power tool.

Referring to FIGS. 2, 4A and 4B, when the power tool 152 is actuated, the drive mechanism 154 and attached drive socket 150 rotate about a common axis of rotation 160. Because the drive socket 150 is engaged with the drive gear 126 of the bolting insert portion 120, the drive gear 126 also rotates about the axis of rotation 160. At the engagement of the drive socket 150 with the drive gear 126, the axis of rotation 160 defines a plane of rotation 162 in which the drive gear 126 rotates. The rotational motion of the drive gear 126 is then translated to the bolting gear 128 via the center gear 130. The bolting gear 128, and the particular socket insert 134 engaged therewith, rotate in the same direction as the drive mechanism 154 of the power tool 152 about a second (e.g. parallel) axis of rotation 164 that is offset from the axis of rotation 160 of the drive gear 126. In an embodiment having an even number of gears, the power tool 152 would need to rotate opposite the desired rotation of the bolting gear 128 because immediately adjacent gears rotate in opposite directions.

While the bolting gear 128 rotates about a different axis of rotation 164 than the drive gear 126, both the bolting gear and the drive gear rotate in the same plane 162. Further, the socket insert 134 rotates about the same axis of rotation 164 as the bolting gear 128 and in a plane of rotation 166 that is parallel to the plane of rotation 162 of the bolting gear 128 and drive gear 126.

Figure 1:
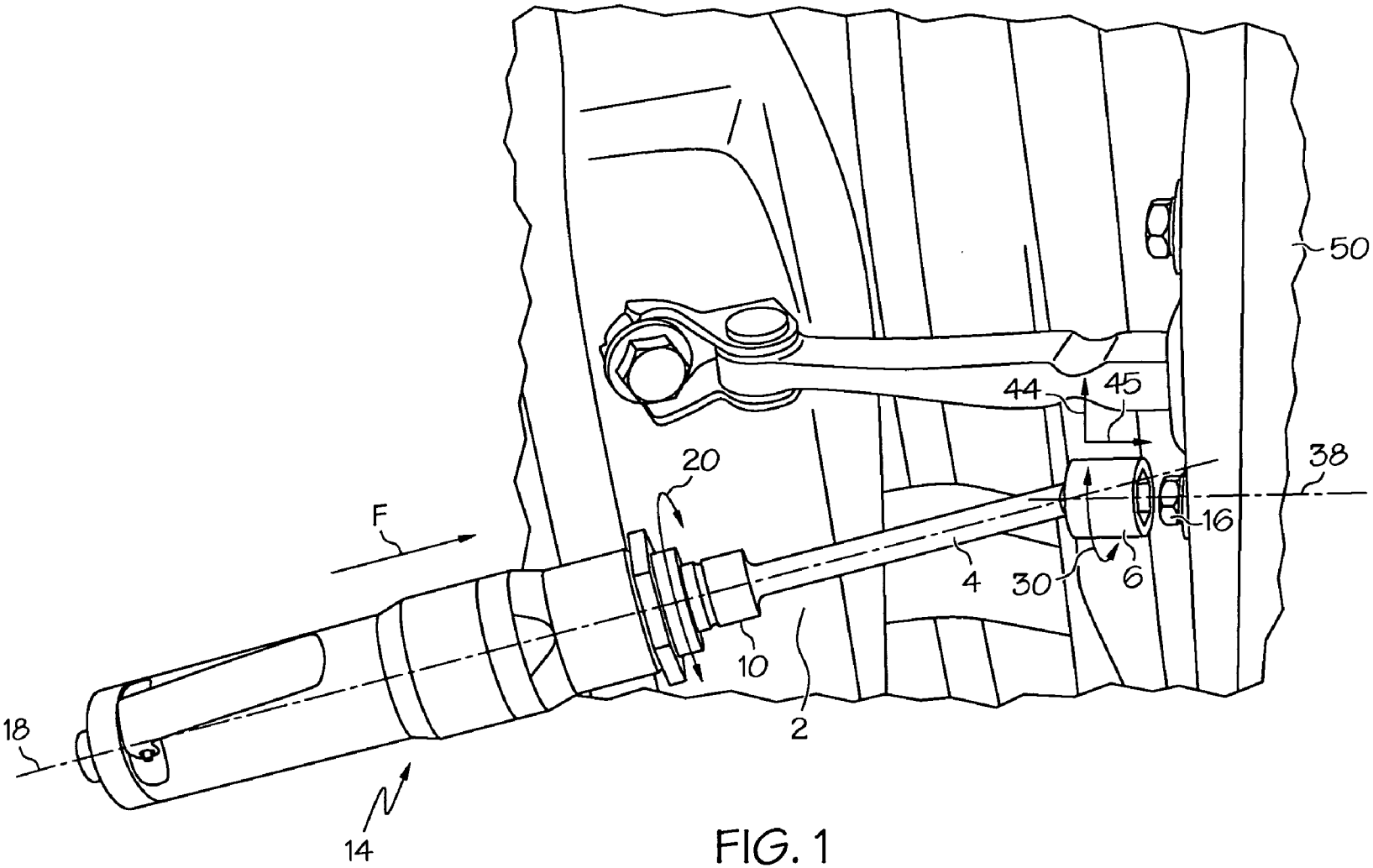
FIG. 1 (PRIOR ART)
FIG. 1 is a schematic diagram of a prior art tool attachment attached to a power tool and shown in use.
Figure 5:
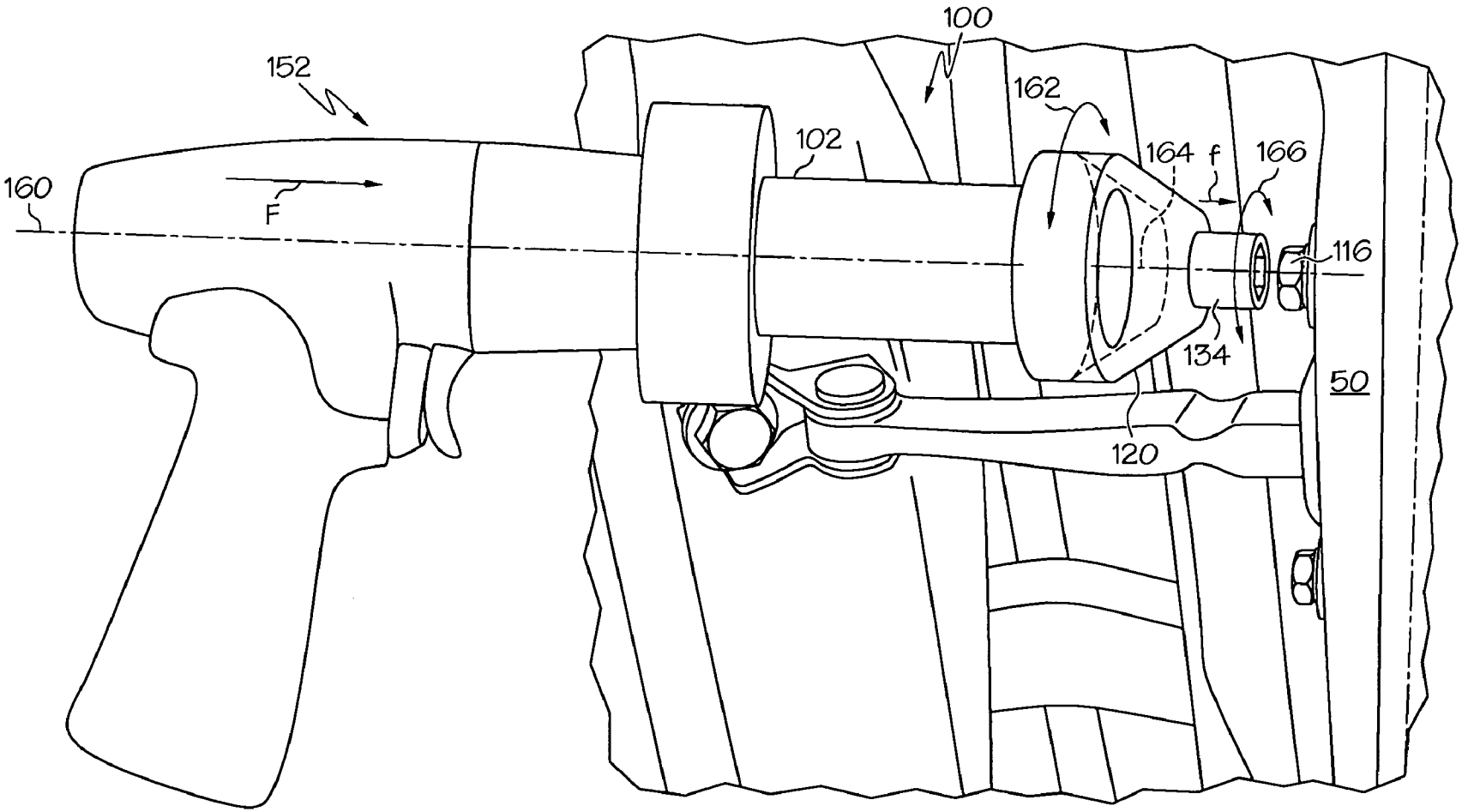
FIG. 5 shows an attachment in accordance with one exemplary embodiment of the present invention as applied to install a fastener.

Referring now to FIG. 5, the attachment 100 is shown in use. In the exemplary embodiment of FIG. 5, the attachment 100 is illustrated as being secured to a power tool 152 and near engagement with a fastener 116 partially secured between a vehicle door and a vehicle body. The orientation of the bolting insert 120 relative to the adapter 102 and power tool 152 allows the socket insert 134 to engage with the otherwise generally inaccessible fastener 116 without the power tool 152 adversely interacting with the surrounding structure. Once engaged, the power tool 152 is actuated, thereby causing rotation of the socket insert 134 and fastener 116. The operator applies a force F to the power tool 152 to keep the socket insert 134 engaged with the fastener 116 as the fastener 116 is advanced toward the workpiece 50. The direction of the force F is generally parallel to the axis of rotation 160 of the power tool 152. The force F is transmitted to the adapter 102, bolting insert 120, socket insert 134, and, ultimately, the fastener 116. Because the socket insert 134 rotates in a plane 166 parallel to the plane of rotation 162 of the power tool, and about an axis of rotation 164 parallel to the axis of rotation 160 of the power tool, the force f exerted on the fastener 116 is substantially parallel to the force F exerted on the power tool 152. Because a sturdier grip on the fastener 116 can be attained through the transfer of force the attachment 100 is less prone to slippage and stripping of the fastener 116 than the prior art attachment shown in FIG. 1.

Moreover, the tool attachment shown and described herein is versatile and may be configured for use in a variety of applications and may be adapted for attachment to power tools of various configurations. The tool attachment may also be configured for installing and removing a wide assortment of fasteners including bolts, nuts, screws, and the like. Further, the tool attachment can be constructed from inexpensive individual components that are readily available thus reducing the overall cost of the tool attachment and replacement parts. The design of the attachment facilitates the easy repair or replacement of component parts thereby reducing repair time and costs. The use of lightweight materials in the construction of the attachment can greatly reduce the overall weight of the attachment and minimizes the ergonomic burden on the operator.

While particular embodiments and aspects of the present invention have been illustrated and described, various other changes and modifications can be made without departing from the spirit and scope of the invention. Moreover, although various inventive aspects have been described, such aspects need not be utilized in combination. It is therefore intended to cover in the appended claims all such changes and modifications that are within the scope of this invention.

What is claimed is:

1. An attachment for a power tool comprising:

an adapter comprising:

a receptacle for removably receiving a bolting insert;

a base having an opening for receiving a power tool wherein, when a power tool is received in the opening in the base, the adapter is rotatable on the power tool between operable positions;

a column positioned between the receptacle of the adapter and the base of the adapter such that the receptacle is spaced apart from the base, the column comprising a hollow channel extending between the opening and the receptacle; and the bolting insert is removably received in the receptacle of the adapter and comprises a drive gear configured to engage a drive mechanism of the power tool, a center gear, and a bolting gear, wherein teeth of the center gear are engaged with teeth of the drive gear and teeth of the bolting gear such that rotation of the drive gear causes rotation of the bolting gear and the bolting insert and the column are substantially perpendicular with one another.

2. The attachment of claim 1 wherein the at least one center gear is disposed on a shaft extending between a base and a cover of the bolting insert, the at least one center gear having a bearing to facilitate rotation about the shaft.

3. The attachment of claim 1 wherein the bolting gear comprises a socket insert for engaging a fastener.

4. The attachment of claim 3 wherein the socket insert comprises a magnet.

5. The attachment of claim 1 wherein the power tool and the attachment comprise a first axis of rotation of a drive mechanism of the power tool and the drive gear and the bolting gear are configured to translate the rotation of the drive mechanism to a parallel axis of rotation centered on the bolting gear.

6. The attachment of claim 5 wherein the drive gear and bolting gear are oriented in a common plane of rotation perpendicular to the axis of rotation of the drive mechanism, the drive gear centered on the axis of rotation of the drive mechanism, the bolting gear centered on the parallel axis of rotation, such that the rotation of the drive mechanism is translated from the first axis to the parallel axis by the bolting insert.

7. The attachment of claim 1 wherein the bolting insert comprises a base and a cover, wherein:

the drive gear is rotatably positioned in the bolting insert such that a first portion of the drive gear extends through an opening in the base of the bolting insert and a second portion of the drive gear extends through an opening in the cover of the bolting insert thereby securing the drive gear between the base of the bolting insert and the cover of the bolting insert;

the bolting gear is rotatably positioned in the bolting insert such that a first portion of the bolting gear extends through an opening in the base of the bolting insert and a second portion of the bolting gear extends through an opening in the cover of the bolting insert thereby securing the bolting gear between the base of the bolting insert and the cover of the bolting insert; and the center gear is rotatably positioned in the bolting insert on a bearing, wherein the bearing is positioned on a shaft disposed in a recessed portion of the base of the bolting insert and a recessed portion of the cover of the bolting insert.

8. The attachment of claim 1 wherein at least one set screw is positioned in the base for securing the adapter to a power tool.

9. The attachment of claim 1 wherein the bolting insert is non-rotatable with respect to the adapter.

10. The attachment of claim 1 wherein an axis of rotation of the drive gear is substantially parallel with the column.

11. An attachment for a power tool comprising:

an adapter comprising:

a receptacle for receiving a bolting insert;

a base having an opening for receiving a power tool wherein, when a power tool is received in the opening in the base, the adapter is rotatable on the power tool between operable positions;

a column positioned between the receptacle of the adapter and the base of the adapter such that the receptacle is spaced apart from the base, the column comprising a hollow channel extending between the opening and the receptacle; and the bolting insert is positioned in the receptacle of the adapter such that the bolting insert and the column are substantially perpendicular with one another, the bolting insert comprising a base, a cover, a drive gear configured to engage a drive mechanism of the power tool, a bolting gear and at least one center gear disposed between the drive gear and the bolting gear, wherein:

the drive gear, bolting gear, and center gear are arranged such that rotation of the drive gear causes rotation of the bolting gear and the center gear;

the drive gear is rotatably positioned in the bolting insert such that a first portion of the drive gear extends through an opening in the base of the bolting insert and a second portion of the drive gear extends though an opening in the cover of the bolting insert thereby securing the drive gear between the base of the bolting insert and the cover of the bolting insert; and the bolting gear is rotatably positioned in the bolting insert such that a first portion of the bolting gear extends through an opening in the base of the bolting insert and a second portion of the bolting gear extends through an opening in the cover of the bolting insert thereby securing the bolting gear between the base of the bolting insert and the cover of the bolting insert.

12. The attachment of claim 11 wherein the center gear is disposed on a shaft extending between the base and the cover of the bolting insert, the center gear having a bearing to facilitate rotation about the shaft.

13. The attachment of claim 11 wherein the bolting insert is removably received by the adapter.

14. The attachment of claim 11 wherein the bolting gear comprises a socket insert for engaging a fastener.

15. The attachment of claim 14 wherein the socket insert comprises a magnet.

16. The attachment of claim 11 wherein the power tool and the attachment comprise a first axis of rotation of the drive mechanism of the power tool and the drive gear, center gear and bolting gear are configured to translate the rotation of the drive mechanism to a parallel axis of rotation centered on the bolting gear.

17. The attachment of claim 16 wherein the drive gear and bolting gear are oriented in a common plane of rotation perpendicular to the axis of rotation of the drive mechanism, the drive gear centered on the axis of rotation of the drive mechanism, the bolting gear centered on the parallel axis of rotation, such that the rotation of the drive mechanism is translated from the first axis to the parallel axis by the bolting insert.

18. The attachment of claim 11 wherein the bolting insert is non-rotatable with respect to the adapter.

19. The attachment of claim 11 wherein at least one set screw is positioned in the base for securing the adapter to a power tool.

20. The attachment of claim 11 wherein an axis of rotation of the drive gear is substantially parallel with the column.

* * * * *